United States Patent [19]

Mawer et al.

[11] Patent Number: 4,998,579

[45] **Date of Patent: * Mar. 12, 1991**

[54] ELECTRODE CASTING SYSTEM

[75] Inventors: Eric L. Mawer; Martin Vanderminnen; Robert D. H. Willans, all of Fruitvale; Michael Graham, Vancouver; Robert E. Manwell, Trail, all of Canada

[73] Assignee: Cominco Ltd., Vancouver, Canada

[ * ] Notice: The portion of the term of this patent subsequent to Nov. 13, 2007 has been disclaimed.

[21] Appl. No.: 350,200

[22] Filed: May 11, 1989

[51] Int. Cl.[5] ..... B22D 47/00; B22D 35/00

[52] U.S. Cl. ..... 164/130; 164/324

[58] Field of Search ..... 164/130, 133, 135, 136, 164/125, 126, 323, 324, 335, 336

[56] References Cited

U.S. PATENT DOCUMENTS

| | | | |
|---|---|---|---|
| 1,755,411 | 4/1930 | Peirce | 164/335 |
| 1,850,477 | 3/1932 | Roth | 164/125 |
| 3,831,659 | 8/1974 | Gerding et al. | 164/133 |
| 4,050,961 | 9/1977 | Knight | 164/128 |
| 4,112,998 | 9/1978 | Sato | 164/136 |
| 4,261,413 | 4/1981 | Blower et al. | 164/323 |
| 4,267,877 | 5/1981 | Leiponen et al. | 164/130 |
| 4,341,256 | 7/1981 | Eberle | 164/135 |
| 4,741,377 | 5/1988 | Roberti et al. | 164/130 |

FOREIGN PATENT DOCUMENTS

| | | | |
|---|---|---|---|
| 54-101720 | 8/1979 | Japan | 164/335 |

*Primary Examiner*—Richard K. Seidel
*Assistant Examiner*—Rex E. Pelto
*Attorney, Agent, or Firm*—Arne I. Fors

[57] ABSTRACT

A system for casting electrodes includes a row of stationary, adjacent, plate casting molds flanked by a launder containing molten metal and a walking beam conveyor. One or two travelling carriages straddle the molds, launder and conveyor. A travelling carriage comprises a pair of rotary dippers, a pair of tipping/dispensers and electrode lifting device. Each dipper scoops a predetermined amount of molten metal from the launder and, while rotating, discharges it into a dispenser. When filled, the dispensers simultaneously tip to fill a mold from both sides of a mold center line over substantially the full length of parallel sidewall portions of the mold, whereby wave action is dampened and molten metal solidifies with even thickness and without flash. The bottom of the mold is water-cooled during casting. While an electrode is cast in one mold, the lifting device lifts anelectrode from an adjacent mold and transfers it onto the conveyor which then moves electrodes over a distance equal to that between electrode center lines. The operation of the travelling carriage, dippers, dispensers, water sprays, lifting device and conveyor are carefully timed, sequenced and concurrent where possible.

22 Claims, 8 Drawing Sheets

ELECTRODE CASTING SYSTEM

This invention relates to the casting of electrodes and, more particularly, to a system for casting electrodes used in metal electro-deposition processes.

BACKGROUND OF THE INVENTION

The system used for casting electrodes with integral lifting lugs for metal electro-deposition processes traditionally includes a number of molds placed at the perimeter of a casting wheel. The wheel either advances the molds one position and stops for filling of the mold and for removing the cooled electrode, or rotates at a steady speed and filling and removing occur while the wheel is in motion.

This system has a number of serious disadvantages. Variations in thickness in the lifting lugs of the electrodes make it difficult for the grabs of a cellhouse crane to pick up a group of electrodes from an electrolytic cell. Because of thickness variations, an operator is required to manipulate the grabs over the electrodes until every electrode in the group is securely held in the grabs before lifting. To use a crane effectively, electrodes with a minimum variation in thickness should be used.

A second disadvantage is the occurrence of a flash of metal at the edges of the electrodes. Flash is a source of electrical shorts during electro-deposition and must be accommodated in the cells by providing sufficient, i.e. increased, spacing between electrodes.

Another reason for increased spacing between electrodes in a cell is the usual provision of a thicker section in the upper portion of an electrode between the lifting lugs. This thicker section is necessary to ensure that there is sufficient metal left after the electro-deposition process to prevent buckling between the lifting lugs in either the grab means of a crane or in other equipment. If an electrode buckles it drops away from the grab means and falls, causing a serious safety hazard and/or damage to equipment.

Variations in lifting lug thickness and flash result from the way melt is poured into the mold. The pouring causes waves to be set up in the molten metal. Because of the "throttling" effect of the lifting lug shape, these waves are amplified in the lifting lugs. If a crest of the wave impinges on the mold walls in the lifting lugs at the moment that the metal solidifies, the metal freezes to the thickness of the original molten wave crest. Whereas another time it may be a valley in the wave that freezes when it impinges on the mold wall. This wave phenomenon, therefore, causes the thickness of the lifting lugs to vary considerably.

In order for the molten metal to solidify the mold is kept at a temperature considerably lower than the freezing point of the metal. Waves created in the main body of an electrode hit the side wall and climb up onto it. Because the side wall is at a lower temperature, the skin of the wave crest in contact with the mold freezes while the remainder of the wave drops back. This results in projections (flash) along the edges of the electrode.

Electrodes with even thickness could be cast in book molds. Although book molds can be used for making copper bullion electrodes for use in a copper refinery, book molds are not suitable for casting electrodes of lead bullion for use in a refinery for the electro refining of lead by the Betts or the bipolar process. Experiments with book mold-cast lead bullion electrodes have shown that the resultant varying fine and coarse grain structures did not provide sufficient strength, causing normally adhering slime to fall into the cells.

BRIEF DESCRIPTION OF THE PRIOR ART

The use of casting wheels and book molds for casting electrodes for metal electro-deposition processes, especially lead and copper electro-refining processes, has been disclosed.

According to U.S. Pat. No. 974 541 there is disclosed a casting wheel for anodes, the molds are cooled from below with water sprays and the molds move with the rotating wheel. In CA Patent 1,019,132 there is disclosed that large lead anodes are cast with a casting wheel with the pouring temperature controlled at 340°-350° C. The flow velocity of the melt is reduced without decreasing its volume when pouring, and discrete first and second cooling steps are sequentially applied to the melt surface while cooling is also applied to the mold bottom. The melt is poured through first and second screens placed in the pouring trough. 400 kg anodes are poured in 12 to 14 seconds, and cooling is started 30 seconds after a lapse of 2 to 3 minutes after pouring. According to U.S. Pat. Nos. 3,981,353, 4,050,961 and 4,124,482, lead alloy anodes are cast in a book mold using a tipping pouring device that provides a number of melt streams along the length of the top of the mold. It is disclosed that coarse grain size should be maintained, the melt temperature controlled, the solidification time and the time during which metal remains molten minimized, the flow of the melt in the mold minimized (the pouring time is 20 to 30 seconds), and the casting kept in the mold 1 to 2 minutes after pouring is completed.

Other prior art relevant to the present invention relates to the casting of molten metal into molds from more than one pouring spout or nozzle and to the use of an insulating material at the edge of the mold. According to U.S. Pat. No. 2,049,148 steel is poured in a slab mold from a crucible having a pair of pouring nozzles, the streams are poured adjacent the mold side walls to create turbulence thereby uniformly washing the walls. According to U.S. Pat. No. 2,151,683 copper is distributed in a number of thin streams into a mold that moves beneath a pouring launder. In U.S. Pat. No. 2,779,073 there is disclosed the continuous casting of rectangular metal bars from a tundish having a plurality of heated pouring spouts. In U.S. Pat. No. 3,326,270 there is disclosed the casting of aluminum and alloys in an open, bottom-chilled mold. The mold has a lining of thin, flexible thermal insulation material at the top inner edge.

According to U.S. Pat. No. 3,456,713 moving pouring ladles each provide two streams of molten metal to a mold. According to U.S. Pat. No. 3,583,470 steel is cast in two streams, one in the centre of the mold, the other at the outer area of the mold. In U.S. Pat. No. 3,726,332 there is disclosed a mold with a strip of heat resistant and thermally insulating sheet material causing a reduction in the degree of upward bowing of the bottom surface edges of the casting. In U.S. Pat. No. 4,509,578 there is disclosed a stationary, continuous, automatic metal pouring apparatus having a plurality of travelling molds and a stationary dispensing vessel with two valve-controlled melt discharge outlets for sequentially pouring melt into the molds.

These prior art disclosures do not provide any teaching on how to eliminate variations in electrode thickness and the formation of flash at the electrode edge. But, as discussed, many advantages can be derived from using electrodes with an even thickness throughout and without flash at the edges.

SUMMARY OF THE INVENTION

We have now found that variations in electrode thickness and the formation of flash can be substantially eliminated by casting the electrode in a mold that is kept stationary during pouring, and by using a method of pouring molten metal that dampens out waves of molten metal in the mold. More specifically, by keeping the mold motionless during pouring of the molten metal, wave action is prevented from being amplified in the space for the lifting lugs of the electrode. By pouring the molten metal into the mold along the sides and from opposite sides of the mold, the waves that are generated from each side meet in the middle of the mold and substantially dampen each other out. The dampening out is enhanced by the fact that the mold is stationary. The formation of flash is prevented by a layer of flexible insulating material applied along the substantially vertical side wall of the mold. This layer acts as an insulator, and a skin of metal is not immediately frozen when molten metal impinges on the side wall of the mold, thereby allowing the melt surface to level out and, thus, eliminating the formation of flash. The mold has a steel bottom and a side wall, and is cooled from below by means of water sprays.

The mold is part of a casting system that produces electrodes efficiently at high productivity. To achieve a high productivity, casting molds are arranged in a single row mounted on a frame. Parallel to this row are a molten metal supply launder on one side and a walking beam conveyor on the other. Straddling the row of molds is a travelling carriage provided with means for transferring molten metal from the launder to a mold, and means for lifting a cooled electrode from another mold and moving the electrode to the walking beam conveyor.

The means for the transferring of molten metal from the launder to the molds includes two rotatable dippers mounted side by side on the travelling carriage. The dippers scoop molten metal, or bullion, from the launder and discharge bullion during rotation through a short delivery pipe to a pair of pivotable tipping melt dispensers that is hydraulically activated and oppositely located on the carriage. Flows of molten metal are discharged from the dispensers into the mold simultaneously in predetermined amounts from opposing sides parallel to and substantially along the length of parallel sidewalls of the mold.

The lifting of an electrode from a mold is accomplished by lifting means comprising a guide frame provided with a number of vacuum suction cups. The lifting means transfers electrodes from the molds to the walking beam conveyor. The lifting means is a part of the travelling carriage and is moved across the travelling carriage by means of a transfer guide arrangement and a hydraulic cylinder.

The walking beam conveyor is compatible with the molds in height and stroke. An electrode is fully supported by the conveyor both when moved and at rest. The walking members are raised, lowered, advanced and retracted hydraulically. If desired, electrodes on the walking beam conveyor may be controlled for quality by means of a system capable of detecting thickness and warp. Defective electrodes are separated from the suitable electrodes and removed from the system for melting and recasting. The suitable electrodes are transferred from the walking beam conveyor onto an indexing conveyor for spacing electrodes so that a set of electrodes may be moved into an electrolytic cell. In a preferred embodiment the system comprises two travelling carriages serving the row of molds, each serving half the number of molds in the row. The system is preferably controlled by a programmable logic controller that makes it possible to operate the system continuously in an automatic or in an interrupted mode using one or both carriages.

It is an object of the present invention to provide a method for the casting of electrodes used in metal electro-deposition processes.

It is another object to provide a casting system for producing electrodes that have a substantially even thickness and essentially no flash.

It is still another object to provide a casting system for the high productivity production of sets of electrodes for setting in electrolytic cells.

Accordingly, the first embodiment of the invention comprises a system for casting electrodes comprising a stationary casting mold having a centre line, a bottom in the shape of an electrode having a substantially vertical continuous sidewall surrounding said bottom, said sidewall including opposed parallel sidewall portions and having a layer of an insulating elastomeric compound attached to the full length of said continuous sidewall inside the mold whereby flash on the electrode edge is essentially eliminated; means for adding molten metal to said mold, said means for adding including two tipping melt dispensers being positioned above said mold parallel to said centre line and the melt dispensing from said dispensers upon tipping of said dispensers flows substantially parallel to the full length of said opposed sidewall portions towards said centre line such that wave action created in the melt in the mold by the dispensing of melt is substantially dampened and electrodes solidify essentially with even thickness; means for applying cooling to said bottom of the mold; and lifting means to remove said electrode from said mold.

According to a second embodiment, there is provided a method for casting electrodes in a stationary casting mold having a centre line, a bottom in the shape of an electrode having a substantially vertical continuous sidewall surrounding said bottom, said sidewall including opposed parallel sidewall portions; comprising attaching a layer of an insulating elastomeric compound to the full length of said continuous sidewall inside the mold whereby flash on the electrode edge is essentially eliminated; adding molten metal to said mold from two tipping melt dispensers positioned above said mold parallel to said centre line by tipping of said dispensers whereby melt dispensing from said dispensers flows substantially parallel to the full length of said sidewall portions towards said centre line such that wave action created in the melt in the mold by the dispensing of melt is substantially dampened and electrodes solidify essentially with even thickness; applying cooling to said bottom of the mold; and lifting said electrode from said mold.

BRIEF DESCRIPTION OF THE DRAWINGS

The objects of the invention and the manner in which they will be realized will become clear from the following detailed description of the preferred embodiments with reference to the accompanying drawings wherein.

DESCRIPTION OF THE PREFERRED EMBODIMENTS

Generally, the invention consists of a system for casting electrodes comprising a stationary plate casting mold in the shape of an electrode, the mold having a continuous, substantially vertical sidewall including parallel sidewall portions; means for adding molten metal to the mold, the means for adding molten metal including two tipping melt dispensers being positioned above the mold parallel to the mold centre line, such that melt dispensing from the dispensers upon tipping flows substantially parallel to the full length of the parallel sidewall portions towards the centre line whereby wave action created by the dispensing is substantially dampened and electrodes solidify essentially with even thickness; means for applying cooling to the bottom of the mold; and lifting means to remove the electrode from the mold. The mold may have a layer of an insulating elastomeric compound attached to the full length of the continuous sidewall whereby flash on the edge of the electrode is essentially eliminated. The mold is one of a multiplicity of molds positioned adjacent each other. The means for adding molten metal also includes a source of molten metal and transfer means to transfer molten metal from the source to the tipping dispensers. The tipping dispensers and the transfer means are supported on a travelling carriage that is adapted to travel over the multiplicity of molds. The transfer means includes two rotary dippers adapted to scoop molten metal from the source and to discharge the scooped molten metal into the tipping dispensers. The rotary dippers and the tipping dispensers sequentially cooperate in a manner whereby the dippers scoop predetermined substantially equal amounts of molten metal from the source, discharge each amount while rotating into the dispensers, and the dispensers tip the amounts into the mold while cooling is applied to the bottom of the mold. A walking beam conveyor is positioned adjacent the multiplicity of molds. The travelling carriage is additionally adapted to travel over the conveyor, and, additionally, the lifting means is supported on the travelling carriage and is adapted to travel laterally over the carriage between the molds and the conveyor. During the sequential cooperation between the rotary dippers and the tipping dispensers, the lifting means removes an electrode from a mold adjacent a mold being filled and transfers the lifted electrode to the conveyor. Upon completion of the sequential cooperation and the transfer of an electrode from a mold to the conveyor, the travelling carriage is indexed and positioned over an adjacent empty mold, and the lifting means is positioned over a mold containing an electrode, while the electrode on the conveyor is simultaneously advanced over a distance equal to the distance between centre lines of two adjacent molds.

Figure 1:
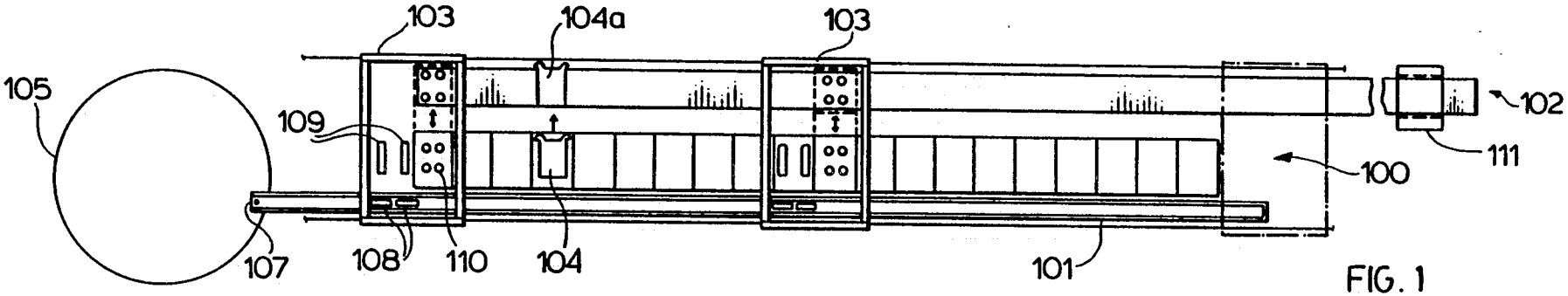
FIG. 1 is a plan view of the electrode casting system.
Figure 4:
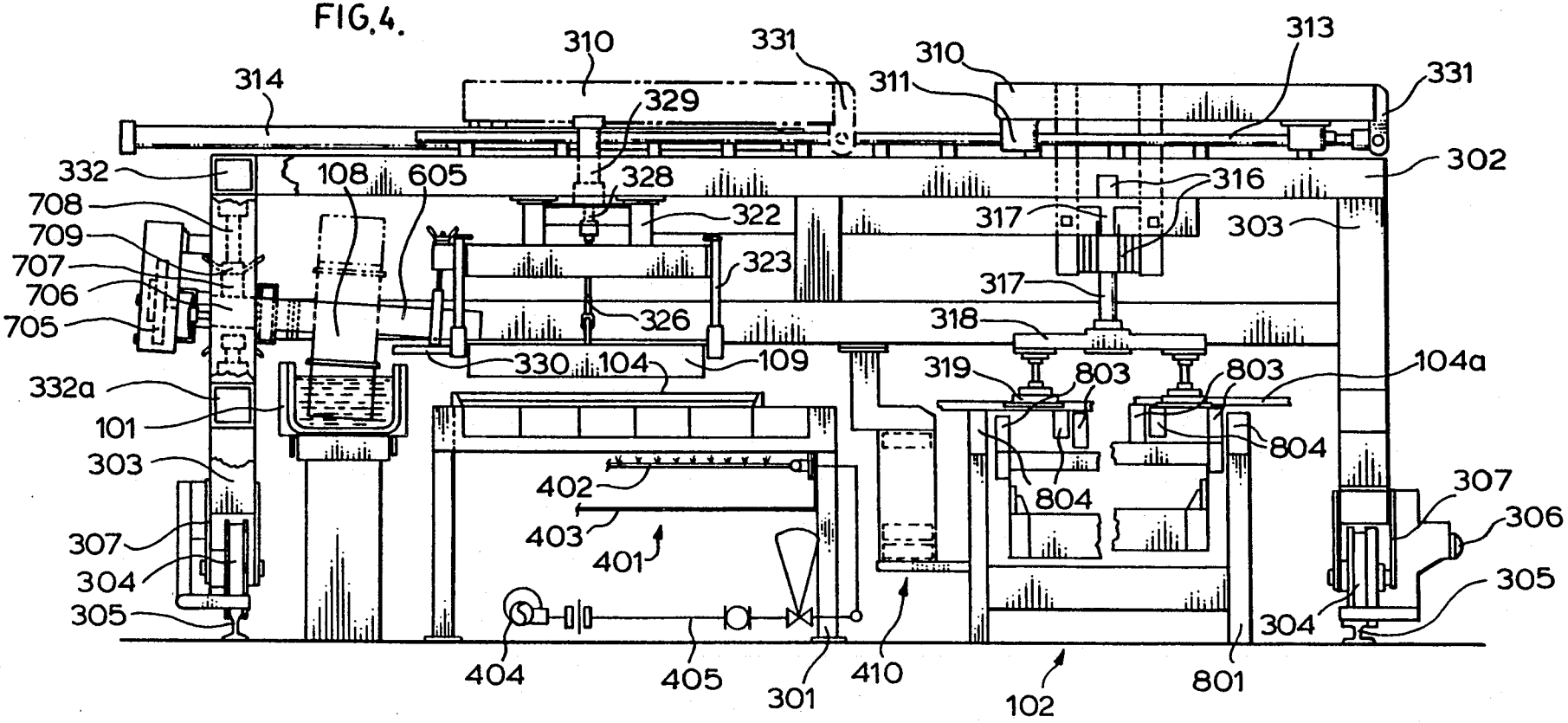
FIG. 4 is a section through the system showing the travelling carriage, the launder, the rotary dippers, the row of molds, the tipping dispensers, the walking beam conveyor, and the electrode lifting means.

In a preferred embodiment, with reference to FIG. 1, the electrode casting system includes a row of plate casting molds 100 flanked by a source of molten metal comprising a launder 101 on one side and a walking beam conveyor 102 on the other side. Row 100, launder 101 and conveyor 102 are straddled by at least one travelling carriage 103. The use of two carriages, as shown, is preferred, as will be explained. The row of molds 100 comprises a multiplicity of electrode molds 104 that are mounted in stationary adjacent positions on a mold support frame 301 (FIG. 4). A travelling carriage 103 comprises a pair of rotary dippers 108, a pair of tipping dispensers 109 and electrode lifting means 110, as will be described.

Figure 2:
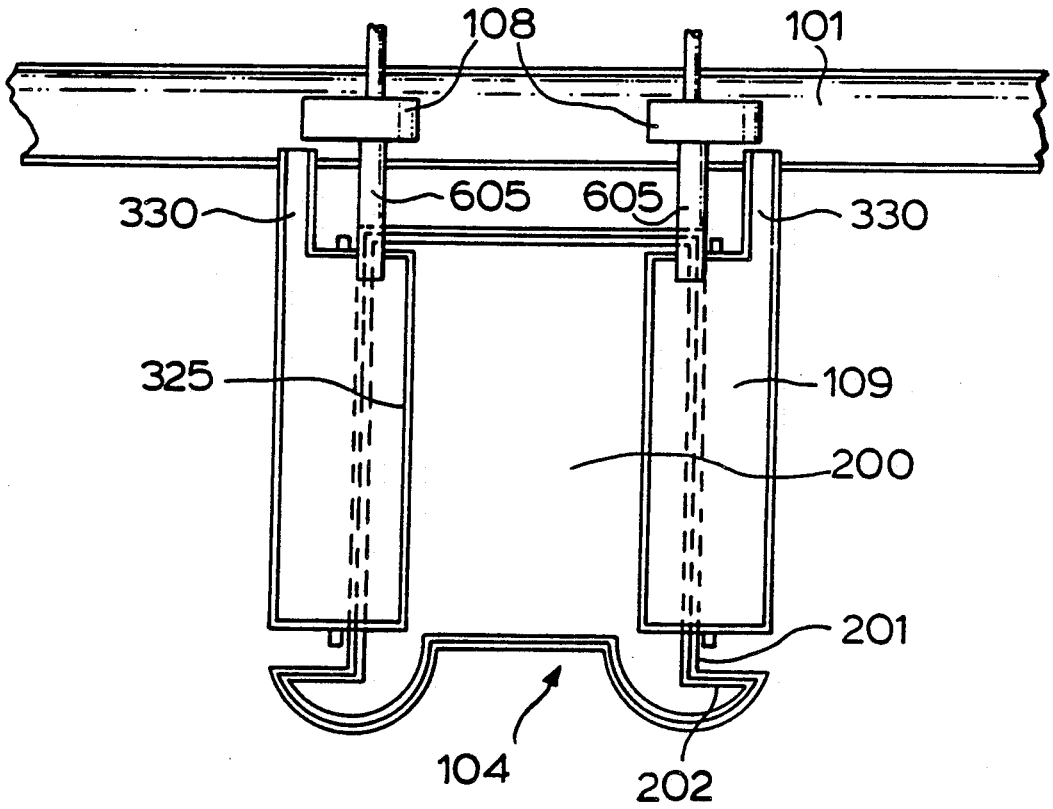
FIG. 2 is a plan view of an electrode mold, the tipping dispensers positioned above the mold, the bullion launder and the rotary dippers.

As shown in FIG. 2, each mold 104, in the shape of an electrode **104*a* (FIG. 1), has a bottom 200 and a continuous substantially vertical sidewall 201 at the periphery of the bottom. Preferably, the sidewall 201 is inclined under a small angle from the vertical, outwardly towards the top of the sidewall. The inside of sidewall 201 is preferably lined with a layer 202 of an insulating elastomeric compound such as, for example, silicon rubber. The molds 104 of row 100 are cooled with water sprays directed against the bottom of the molds from a spray system generally indicated with 401 (FIG. 4). The system 401 comprises a number of nozzle pipes 402 for directing water sprays against the mold bottoms, a catch basin 403, a circulating pump 404 and connecting pipe 405** between pump and basin.

The source of molten metal further comprises a bullion vessel 105 and a pump (not shown). The launder 101 is suitably heated, and is fed with molten metal (bullion) from bullion vessel 105 by means of the pump. The pump continuously pumps bullion into the launder. The launder is filled with bullion, any excess flowing back into bullion vessel 105 over overflow 107 in the end of the launder over vessel 105. Optionally, a quality control station 111 may be located towards the end of conveyor 102.

Figure 3:
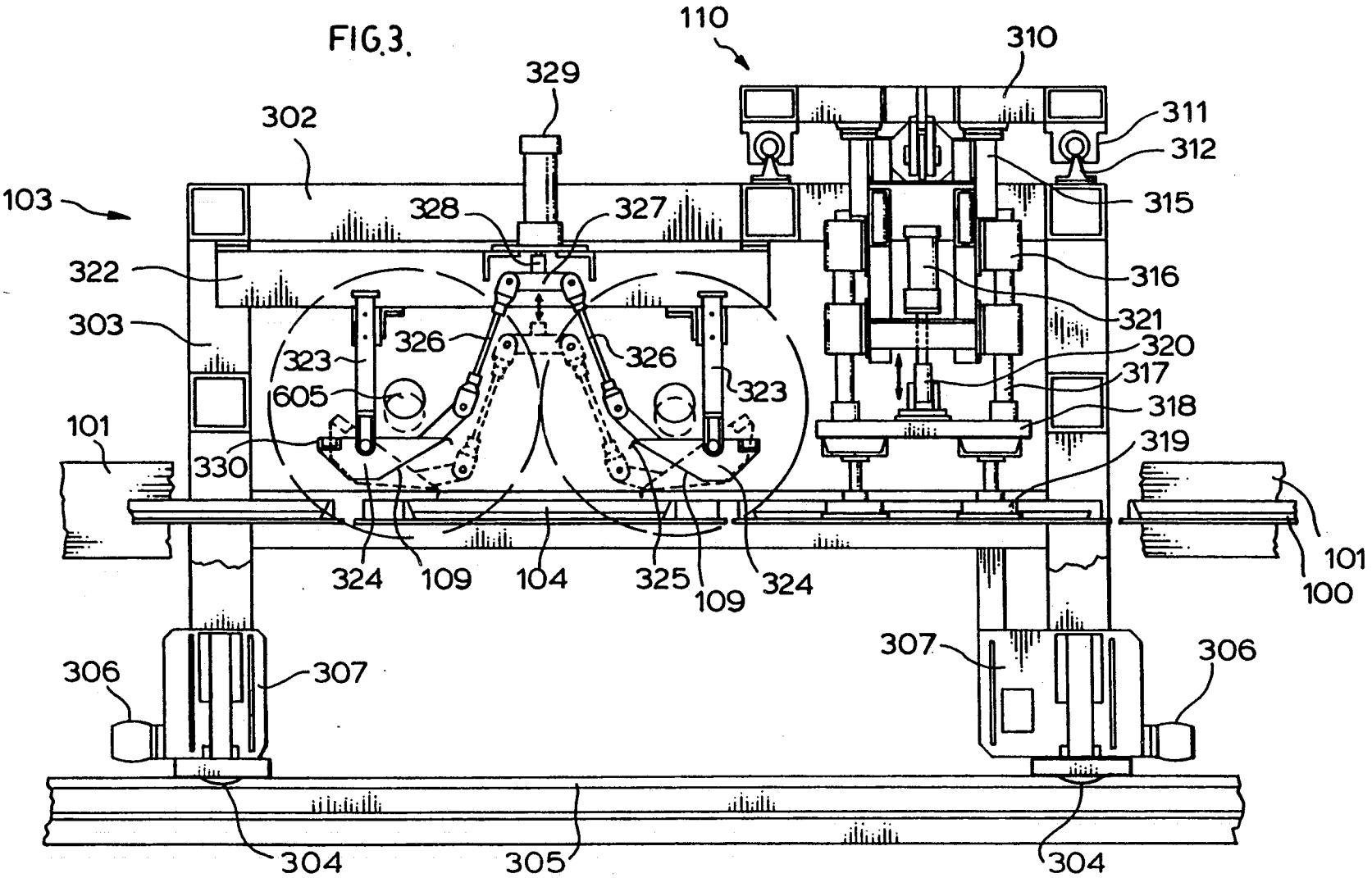
FIG. 3 is a side view of the travelling carriage showing the tipping dispensers and electrode lifting means.

With reference to FIGS. 3 and 4, a travelling carriage, generally indicated with 103, straddles the row of molds 100, the launder 101 and the walking beam conveyor generally indicated with 102. Carriage 103 consists of a square or rectangular carriage frame 302 that is supported by carriage frame posts 303, one at each of its corners. The lower extremity of each frame post 303 is provided with a rotatable flanged wheel 304 movable on a pair of parallel rails 305. Carriage 103 can travel along the full length of the row of molds 100. Carriage 103 is movable by two carriage drive motors 306, each mounted on opposite frame posts 303 at each rail 305 and operatively connected by means of a carriage drive 307 to a wheel 304. Rails 305 extend beyond the row of molds 100 at both ends to provide space for easy repair of the carriage.

On the travelling carriage 103 is mounted an electrode lifting means generally indicated with 110. Lifting means 110 can move transversely to the row of molds 100, and serves to lift a solidified electrode **104*a* from a mold 104, and to move it to and lower it onto walking beam conveyor 102. Lifting means 110 is suspended from a lifting means frame 310 that is reciprocably movable by transfer guides 311, each one on a parallel sliding rail 312 mounted on carriage frame 302. Lifting means frame 310 is movable by a piston 313, attached to bracket 331 on one end of lifting means 110, of hydraulic cylinder 314 mounted on frame 202 between a position (indicated with interrupted lines) over the molds 104 of row 100 and a position over conveyor 102**.

A power track, generally indicated with 410, is situated along the length of the system between the row of molds 100 and the conveyor 102 to provide electrical and hydraulic power to the various parts of the system as required.

Suspended from the lifting means frame 310 is a lifting means guide frame 315 having on each side two vertically spaced-apart guides 316. Each pair of guides 316 is adapted to slidably accommodate suction cup plate support columns 317, at which lower ends suction cup plate 318 is attached. The suction cup plate has a number of vacuum suction cups 319 attached thereto on its bottom surface. Cups 319 are operatively connected to a source of vacuum (not shown), and have sufficient capacity to lift an electrode from a mold. The suction cup plate 318 is vertically movable by centrally attached piston 320 of lifting means hydraulic cylinder 321 mounted on lifting means guide frame 315.

Also mounted on travelling carriage 103 is a pair of tipping dispensers 109. The dispensers 109 are mounted on a dispenser frame 322 that is suspended from carriage frame 302. Each dispenser 109 is lengthwise suspended between a pair of dispenser support bars 323 that is fixedly attached to dispenser frame 322. Dispenser bars 323 are rotatably attached at the top of dispenser side plates 324 above the centre of gravity of the dispenser such that the dispenser can rotate.

The tipping dispensers, which may have any one of a number of suitable shapes, are located above a mold and have a length that, preferably, is slightly shorter than the length of a mold 104. The shape shown in FIGS. 2, 3, and 4 is an elongated shape with a rectangular cross section between support bars 323 and a V-like cross section perpendicular thereto.

The tipping dispensers each has an overflow edge or lip 325. The centre of overflow edge 325 is fixedly attached to one end of a hingeable dispenser tipping linkage 326 rotatably connected at its other end to a crossbar 327. Crossbar 327 is horizontally attached to the piston 328 of the tipping dispenser hydraulic cylinder 329 on top of dispenser frame 322.

The dispensers 109 are suspended in opposing directions such that the overflow edges 325 face each other. In the top of the dispenser side plate 324 of each dispenser that is nearest the launder 101 is attached one end of an overflow 330, its other end being above launder 101. The overflow serves for the return of any excess melt from the dispensers to the launder. In FIG. 3, the tipped position of dispensers 109 is indicated with interrupted lines.

Although the tipping dispensers, their shape and suspension and location over the mold are described with specific reference to the drawings, variations may be made. In copending application U.S. Ser. No. 350,290, assigned to the present assignee, is described a method and apparatus for the casting of metal, such as, for example, the casting of electrodes, which includes an embodiment of the present invention. Briefly, in the co-pending application a method and apparatus are described whereby molten metal is poured from two opposing pouring devices (dispensers) over the full length or width of a plate mold, the molten metal from the devices flowing towards each other and dampening any wave action, whereby castings are obtained of substantially even thickness and without flash at the edges.

With reference to FIGS. 4–7, a pair of rotary dippers 108 is rotatably mounted on one side of the row of molds 100 such that the dippers can rotate in the launder 101 in a direction substantially parallel to the launder centre line. Each dipper 108 is a vessel that has a cross section in the shape of a circle sector enclosing an angle of about 90°. A dipper (FIG. 6) comprises two parallel, spaced-apart, sector-shaped plates 601, two rectangular radial plates 602 and 603 attached between the sector-shaped plates 601 at their outside radial edges, and a curved plate 604 attached to the curved edges of and between sector-shaped plates 601 and to radial plate 603. The dipper is attached to a delivery pipe 605 in proximity the radii centre points of the sector-shaped plates 601. Radial plates 602 and 603 are attached with one of their edges to the circumference of delivery pipe 605 in spaced-apart axial direction. The attachments of the sector-shaped plates 601 and radial plates 602 and 603 form ,a curved area on the circumference of delivery pipe 605 that has been cut out to provide two communication openings 607 between dipper 108 and delivery pipe 605. Radial plate 602 extends from pipe 605 partly towards curved plate 604 leaving a rectangular opening 606 between plates 601, plate 602 and plate 604. Opening 606 serves as entry for melt from the launder 101 when the rotary dipper rotates through the melt. The radial plate 602 with opening 606 is at the side of the dipper most advanced in the direction of rotation.

The dippers 108 are attached to parallel rotatable delivery pipes 605 as described. The pipes 605 are closed at one end with a flange 701 that is attached to a flange 702 mounted on one end of a drive shaft 703. Shafts 703 with attached pipes 605 are adapted for rotation by a single motor 704 and chain drive 705 mounted on a dipper frame 706. Frame 706 is under small angle from the horizontal such that the delivery pipes 605 slope downward from the flanged ends to the open end above the dispensers 109. The dippers 108 are, consequently, also slightly tilted under the same small angle. The angle is conveniently about 3°, and the angling ensures that bullion scooped by the dippers from the launder drains completely through the delivery pipes into the dispensers during rotation of the dippers.

The dipper frame 706 is vertically adjustably mounted by means of sleeves 707 on threaded support columns 708. Dipper frame 706 is normally kept in fixed positions by the threaded upper and lower lock nuts 709 on either side of the sleeves 707 on support columns 708. The threaded support columns 708 are positioned between one side 332 of carriage frame 302 and a cross bar **332*a* between two carriage frame posts 303. To change the volume of bullion scooped from the launder by the dippers, a vertical adjustment of the dippers can be made by loosening the lock nuts 709**, adjusting the depth of immersion of the dippers in the bullion and then fastening the locknuts.

Figure 5:
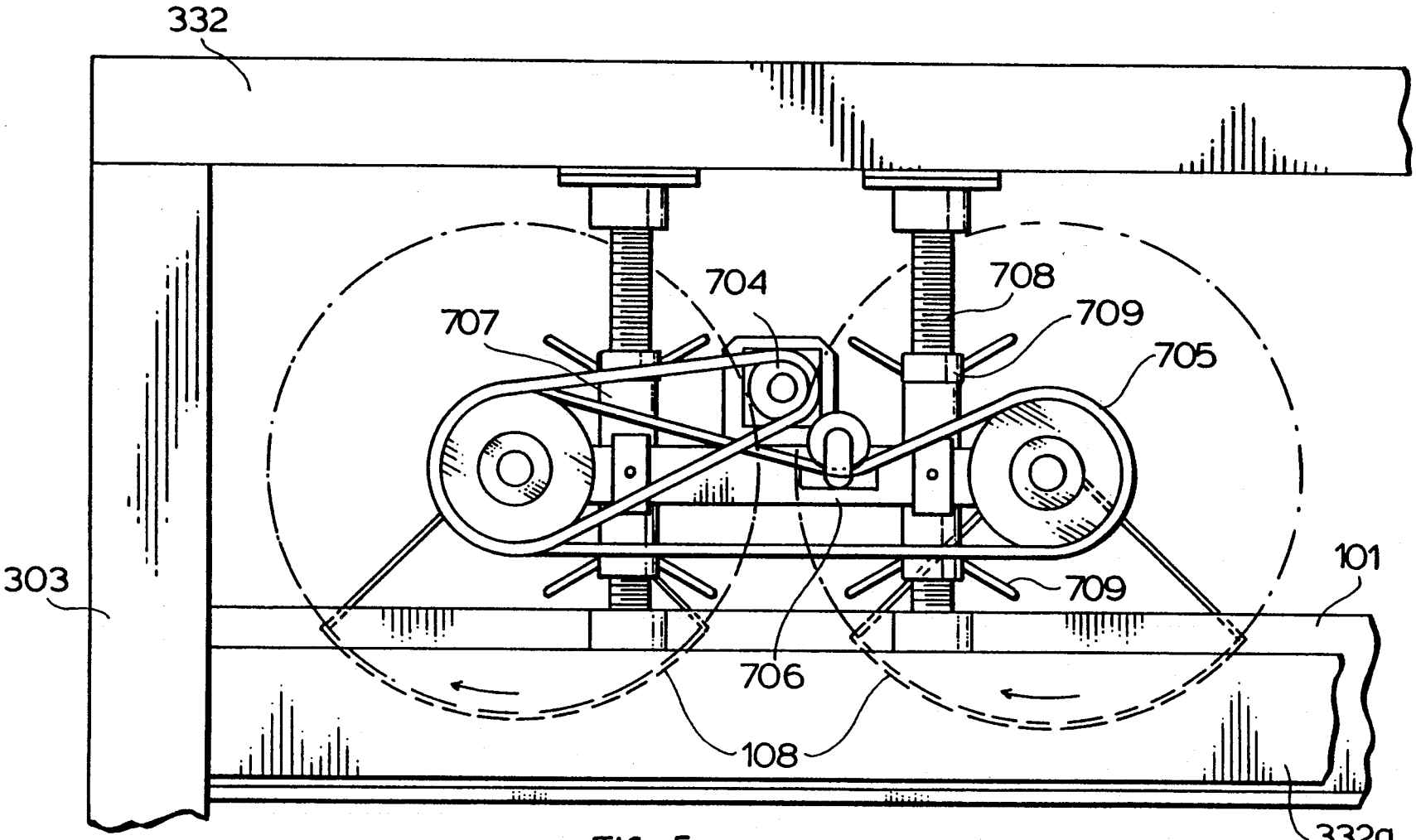
FIG. 5 is a side view of the rotary dippers and drive means in relation to the bullion launder.
Figure 6:
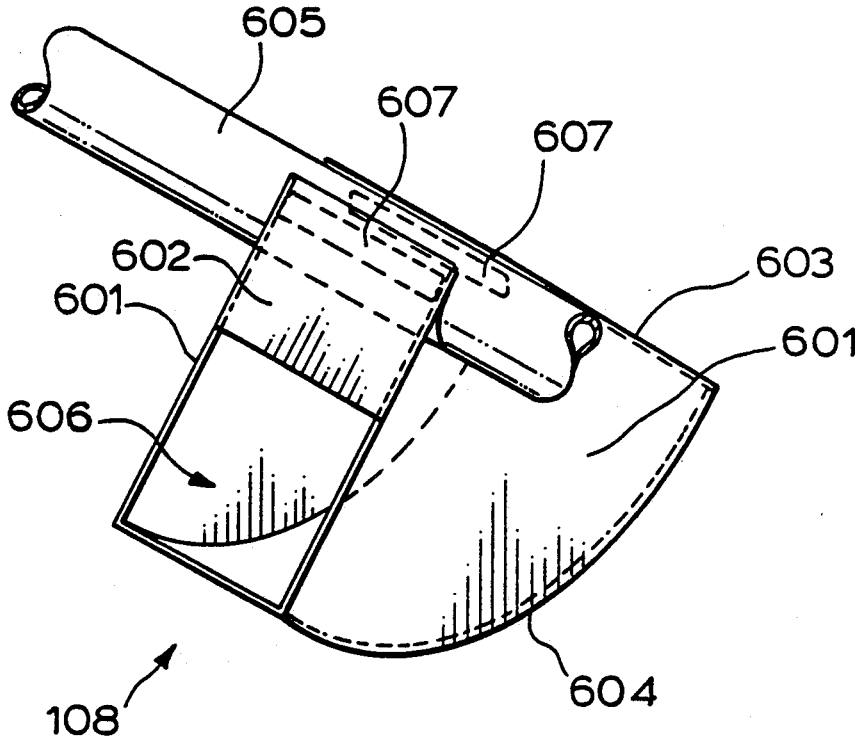
FIG. 6 is an isometric view of a rotary dipper mounted on a melt delivery pipe.
Figure 7:
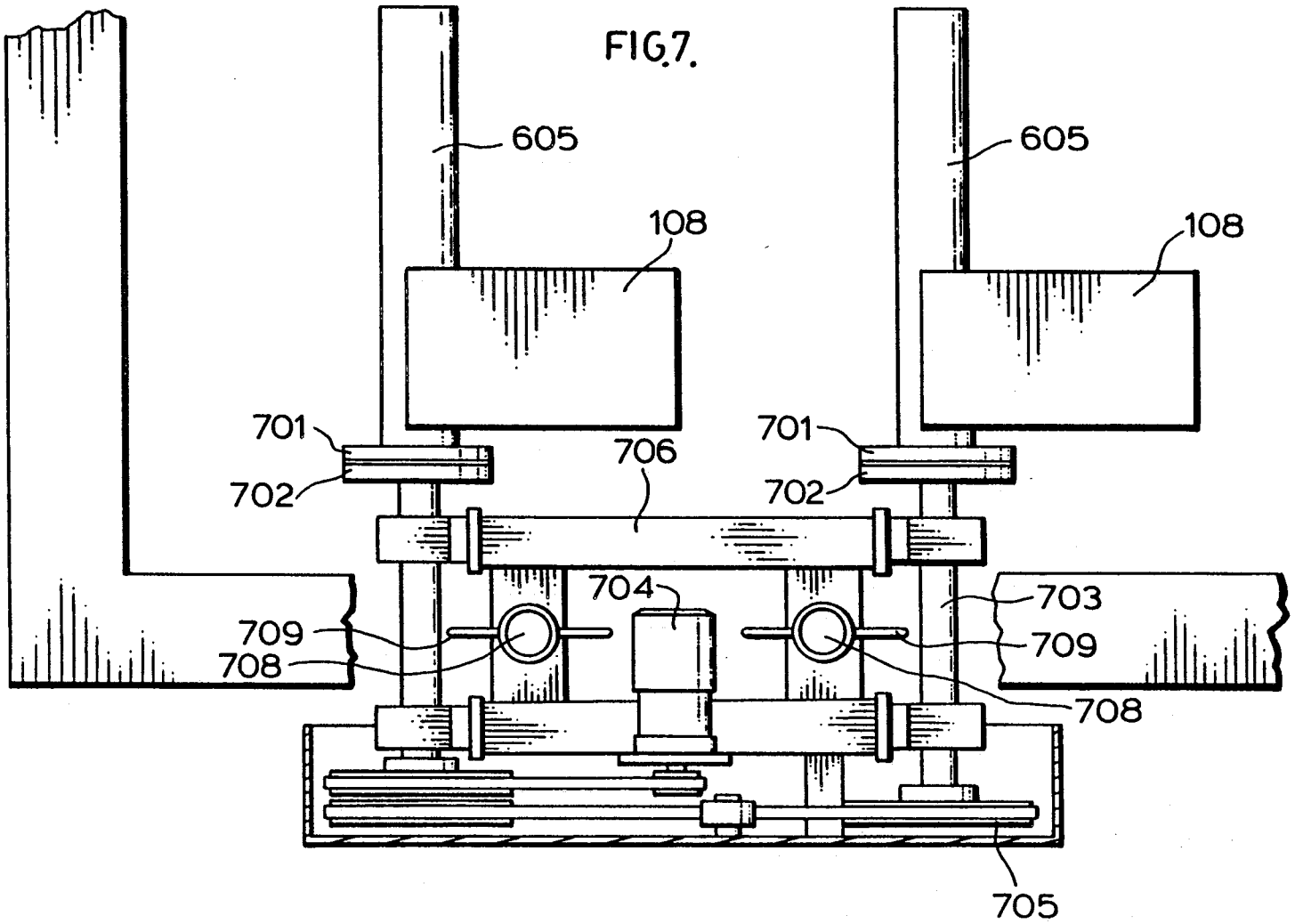
FIG. 7 is a plan view of the rotary dippers and drive means.

The rotational path of each of the dippers 108 is indicated with interrupted dot lines in FIGS. 3 and 5, and the upper position with interrupted lines in FIG. 4.

With reference to FIGS. 1, 4, 8 and 9, the walking beam conveyor generally indicated with 102 is adapted to forward electrodes 104*a* deposited thereon by the electrode lifting means 110. For illustration, the right half of the conveyor shown in FIG. 4 is in the raised position and the left half in the lowered position. The conveyor is mounted on a conveyor frame 801. The conveyor is driven by a single hydraulic drive, generally indicated with 802. The conveyor comprises four parallel movable walking beams 803 and four parallel stationary beams 804. Each walking beam 803 is located adjacent a stationary beam 804. The stationary beams 804 are mounted in fixed positions on the conveyor frame 801.

The four walking beams 803 are fixedly mounted on a movable walking beam frame 805 having a number of cross tie beams 806. Underneath and at each outside elongated side of frame 805, and spaced along its length, are slidably attached plates 807 (two shown in FIG. 8). Each plate has a pair of rollers 808 mounted thereon which can cooperate with wedges 809 (two pair shown) mounted on the conveyor frame 801. Walking beam frame 805 is movably and slideably spaced by pairs of rollers 818 from conveyor frame 801.

Figure 8:
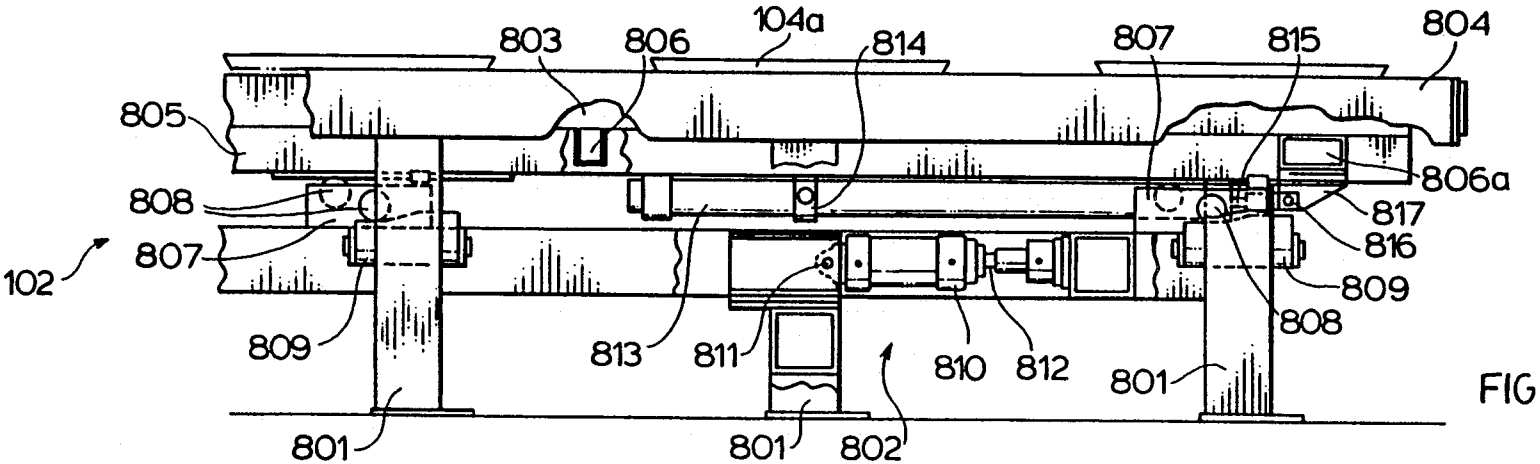
FIG. 8 is a side view of a portion of a section of the walking beam conveyor and its drive mechanism.
Figure 9:
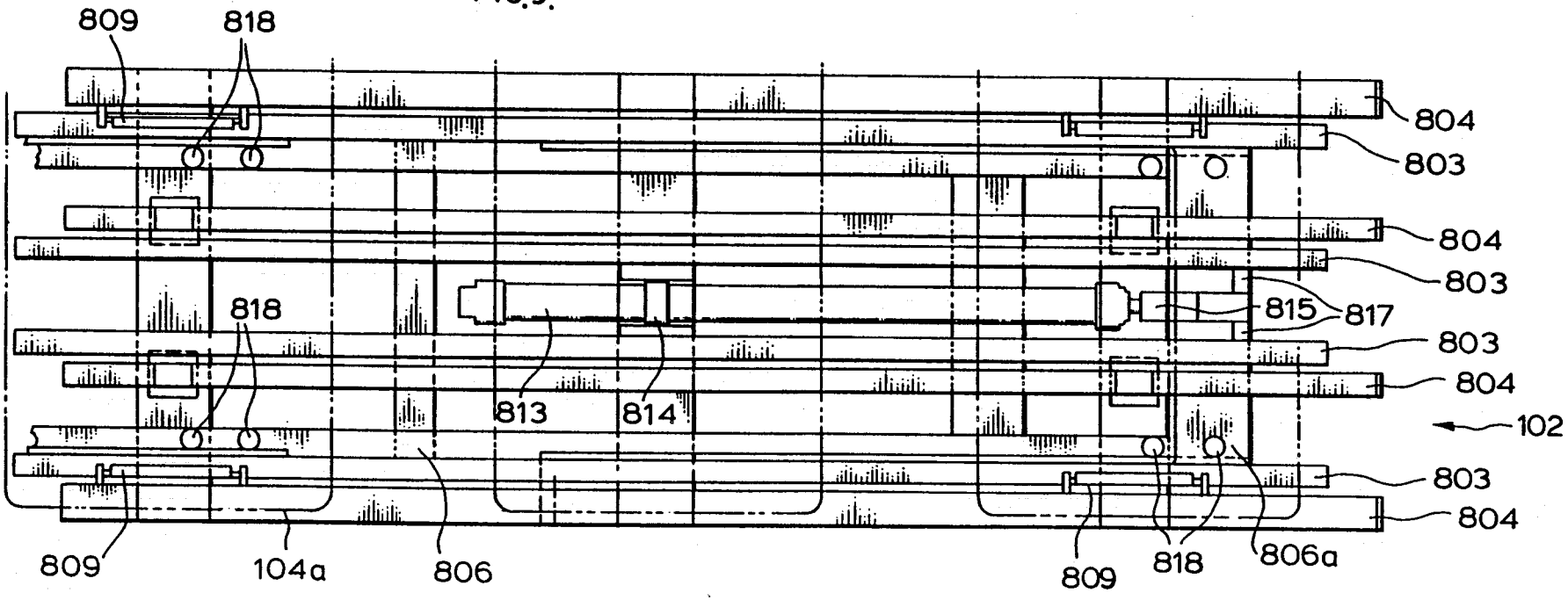
FIG. 9 is a plan view of the portion of the conveyor shown in FIG. 8.

The hydraulic drive 802, most clearly shown in FIGS. 8 and 9, is located at the end and on the centre line of the conveyor, and is operatively connected to tie beam 806*a* of walking beam frame 805. Drive 802 comprises a hydraulic lift cylinder 810 pivotably connected at pivot point 811 to conveyor frame 801. The lift piston 812 of cylinder 810 is operatively connected to the slideable plates 807. The lift piston 812 has a relatively short stroke sufficient to push the rollers 808 and walking beam frame 805 onto the wedges 809, thereby raising the walking beams 803. The hydraulic drive 802 also comprises a hydraulic travel cylinder 813 that is pivotally connected at pivot point 814 to conveyor frame 801. Travel cylinder 813 has a long-stroke piston 815 that is pivotably connected at 816 between parallel brackets 817 attached underneath tie beam 806*a*. When piston 815 extends from or retracts into travel cylinder 813 the walking beams, lifted on wedge-shaped plates 809 by lift cylinder 810, move back or forth.

The height of conveyor 102 is compatible with the height of the row of molds 100. The use of four walking beams is sufficient to support electrodes 104*a* adequately. But it is understood that a higher or lower number of beams may be used. Adequate support is necessary to prevent any still hot electrodes from warping.

The optional electrode inspection station 111 is preferably located at the end of and above the conveyor 102. In station 111, electrodes passing over the conveyor are inspected by a system that is capable of detecting the thickness and any warp of the electrodes. Defective electrodes are removed, and suitable electrodes are transferred onto an indexing conveyor (not shown), whereon the electrodes are vertically positioned and spaced into sets that are subsequently moved to electrolytic cells (not shown).

According to the method of the invention, lead bullion from a lead smelter is charged to bullion vessel 105. Bullion is continuously pumped by a bullion pump into the heated launder 101. Bullion fills the launder to the height of overflow 107, and excess overflows back into bullion vessel 105. The travelling carriage 103 is indexed over one of the empty molds 104 of the row of molds 100. The rotary dippers 108 are rotated, preferably continuously, in tandem and cooperate in phase with the tipping dispensers 109. Each dipper 108, appropriately adjusted in height, scoops a predetermined amount of bullion from the bullion flowing through the launder, while rotated in a direction such that the opening 606 in the dipper enters the bullion first. The dippers are rotated by means of motor 704 and chain drive 705. As soon as the rotating dippers reach a position at which bullion reaches the openings 607 in the delivery pipe 605, bullion will start to discharge through pipes 605 into the tipping dispensers 109, aided by the downward slope. The dispensers are in the horizontal filling position with piston 328 retracted into hydraulic cylinder 329. When the rotating dippers reach the apex of rotation, the dippers are empty and the predetermined amounts scooped from the launder have been quantitatively discharged into the tipping dispensers 109.

As soon as the tipping dispensers 109 are filled with the predetermined amount of bullion, dispenser tipping hydraulic cylinder 329 is activated, piston 328 extends, and linkages 326 push the overflow edges 325 of the dispensers down, with the result that bullion flows into two streams into mold 104. The two streams that flow into the molds over substantially their full lengths meet in the centre of the mold such that any wave action is essentially dampened and substantially no flash is formed. In an alternative embodiment (not shown) the dispensers 109 are suspended from the frame 322 and linked to the piston 328 in such a manner that the dispensers are initially located close to and parallel to the centre line of the mold. When the piston 328 extends from the activated cylinder 329, the dispensers start moving away from each other over arcuate paths that end at about the sidewall portions of the mold that are parallel to the centre line. Bullion flows from the dispensers during the moving of the dispensers over the arcuate paths. The pouring is more gentle and less wave action occurs. Either embodiment results in solidified electrodes that have a substantially even thickness throughout and have essentially no flash at the edges.

The mold is being cooled from below by directing water sprays against the bottom of the mold. The water sprays at each mold are automatically activated before the pouring has started and are shut off when the electrode is lifted from the mold. When both the dispensers are in the fully tipped position, all bullion has flowed into the mold, and the dispensers are returned to the horizontal filling position by retracting piston 328 into activated tipping hydraulic cylinder 329. Meanwhile the dippers have scooped up a new charge which is discharged into the tipping devices after the travelling carriage has been indexed over the next empty mold to repeat the cycle.

At the same time that the dippers 108 are charged and discharged and bullion is charged into the mold from tipping devices 109, the electrode lifting means 110, which is positioned over the mold adjacent the mold being filled (piston 313 retracted into cylinder 314), is activated to remove the electrode that has been formed in a previous pouring. Lifting means piston 320 is extended from activated hydraulic cylinder 321 to lower the suction cup plate 318 with cups 319 onto the surface of the electrode. Vacuum is applied, and cylinder 321 is re-activated to retract piston 320 and suction cups 319, thereby removing the electrode 104*a* from its mold. Subsequently, the lifting means frame 310 is moved over rails 312 to over walking beam conveyor 102 by activating hydraulic cylinder 314 mounted on main frame 302 thereby extending piston 313. Lifting means hydraulic cylinder 321 is again activated to lower the suction cups with the attached electrode onto the conveyor 102. The vacuum is released to loosen the suction cups, the suction cup plate is raised, and the lifting means is returned to over the row of molds to pick up the next electrode from a mold.

Electrodes on the walking beam conveyor 102 are moved over a distance between centre lines of two adjacent electrodes at a time, by moving the walking beams 803 in a repeating sequential pattern of up, forward one distance, down and back the same distance. The electrodes on the conveyor are thereby advanced over a distance equivalent to adjacent mold positions of the row of molds 100. The action of placing an electrode **104*a* on the conveyor by electrode lifting means 110 activates the hydraulic lift cylinder 810 whereby lift piston 812 extends to push the rollers 808 onto wedges 809 resulting in a lifting of walking beams 803 and lifting electrodes from stationary beams 804. Hydraulic travel cylinder 813 is then activated and extending long-stroke piston 815 advances the walking beams and electrodes over the required distance. The lift cylinder 810 then retracts piston 812 causing rollers 808 to roll back off wedges 809 thereby lowering walking beams 803 resulting in placing the advanced electrodes on the stationary beams. Once the walking beams are lowered, the long-stroke piston 815 is retracted into travel cylinder 813** pulling the walking beams back into their original position.

The action of placing an electrode on the conveyor activates the conveyor drive 802 to raise, feed forward, lower and retract the walking beams 803. If no electrode is placed on the conveyor, the conveyor will not be activated and will wait until the next electrode is placed on the conveyor. The operation is linked to the rate at which the conveyor moves to avoid placing electrodes on top of each other. The electrodes may then be moved to the, optional, electrode inspection station 111 at the end of the conveyor where they can be inspected for thickness and warp by a suitable detection system. Flawed electrodes are rejected from the end of the conveyor and good electrodes are moved from the walking beam conveyor onto an indexing conveyor where they are formed into sets of vertical electrodes suitable for transferring into electrolytic cells for the electro-deposition of metal.

The operation of the casting system, i.e., the movement of a travelling carriage, the filling of the rotating rotary dippers, the discharging of the dippers into the tipping dispensers, the tipping of the filled dispensers to empty into a mold, the repositioning of the dispensers, the cooling of the mold with watersprays, the removal of the electrodes from molds onto the walking beam by the lifting means, the positioning of the lifting means, and the advancing of the electrodes on the walking beam conveyor are carefully timed, sequenced and concurrent where possible.

In a preferred embodiment of the invention, the system comprises two travelling carriages serving the row of molds, each serving half the number of molds in the row. The system is, preferably, controlled by a programmable logic controller that makes it possible to operate the system continuously in an automatic or in an interrupted mode using one or both carriages.

In a specific embodiment, an electrode production cycle of 20 seconds was used, which included simultaneous pouring and lifting operations, some of which were partly or wholly overlapping. In the pouring of an electrode, the dippers were rotated with a speed of one rotation every six and a half seconds, charging the tipping dispensers took eight seconds, charging a mold simultaneously from both dispensers required five seconds, and returning the dispensers to the charging position took one and a half seconds. The rotation of the dippers only continued when the travelling carriage had been located correctly during indexing, and the controller had sensed that the mold to be filled was empty. In the simultaneous removal of a cooled electrode from an adjacent mold, lowering the vacuum cups onto the electrode, applying the vacuum and lifting the electrode each took one second, moving the electrode to the conveyor took five seconds, lowering the electrode, releasing vacuum and raising the vacuum cups required two, one and two seconds, respectively, and the lifting means was returned to over the row of molds in five seconds. The indexing of the travelling carriage over the next mold required five seconds. Using two carriages over a row of 20 molds, each carriage serving 10 molds, 20 electrodes were cast and removed from the molds and moved onto the conveyor in 200 seconds, the carriages were returned to the first of the 10 molds in 30 seconds, for a total operation sequence of 230 seconds. The production rate was, therefore, 5.22 electrodes per minute.

It is understood that variations and modifications may be made in the system without departing from the scope and purview of the appended claims.

We claim:

1. A system for casting electrodes comprising a stationary casting mold having a centre line, a bottom in the shape of an electrode having a substantially vertical continuous sidewall surrounding said bottom, said sidewall including opposed parallel sidewall portions and having a layer of an insulating elastomeric compound attached to the full length of said continuous sidewall inside the mold whereby flash on the electrode edge is essentially eliminated; means for adding molten metal to said mold, said means for adding including two tipping melt dispensers being positioned above said mold parallel to said centre line and the melt dispensing from said dispensers upon tipping of said dispensers flows substantially parallel to the full length of said opposed sidewall portions towards said centre line such that wave action created in the melt in the mold by the dispensing of melt is substantially dampened and electrodes solidify essentially with even thickness; means for applying cooling to said bottom of the mold; and lifting means to remove said electrode from said mold.

2. A system according to claim 1, wherein said mold is one of a multiplicity of molds positioned adjacent each other; and said means for adding molten metal also includes a source of molten metal and transfer means transfer molten metal from said source to said tipping dispensers.

3. A system according to claim 2, wherein said dispensers and said transfer means are supported on a travelling carriage adapted to travel over said multiplicity of adjacent molds.

4. A system according to claim 3, wherein said transfer means includes two rotary dippers adapted to scoop molten metal from said source of molten metal and to discharge the scooped molten metal into said tipping dispensers.

5. A system according to claim 4, wherein said rotary dippers and said tipping dispensers sequentially cooperate in a manner whereby said rotary dippers scoop predetermined substantially equal amounts of molten metal from said source of molten metal, discharge into said dispensers each of said amounts while rotating, and said dispensers discharge said amounts into a mold while cooling is applied to the bottom of said mold.

6. A system according to claim 5, wherein a walking beam conveyor is positioned adjacent said multiplicity of molds.

7. A system according to claim 6, wherein said travelling carriage is additionally adapted to travel over said conveyor.

8. A system according to claim 4, wherein a walking beam conveyor is positioned adjacent said multiplicity of molds, said travelling carriage is additionally adapted to travel over said conveyor, said lifting means is additionally supported on said travelling carriage, and said lifting means is adapted to travel transversely over said travelling carriage between said multiplicity of molds and said conveyor.

9. A system according to claim 8, wherein said rotary dippers and said dispensers sequentially cooperate in a manner whereby said rotary dippers scoop predetermined substantially equal amounts of molten metal from said source of molten metal, discharge into said tipping dispensers each of said amounts while rotating, said dispensers tip said amounts simultaneously into a first mold, and wherein during the sequential cooperation the lifting means removes an electrode from a mold adjacent said first mold and transfers the lifted electrode to said conveyor.

10. A system according to claim 9, wherein upon completion of said sequential cooperation and said transfer of electrode from the adjacent mold to the conveyor, said travelling carriage is indexed to over an empty mold adjacent said first mold and said lifting means is positioned over said first mold, while the electrode on said conveyor is simultaneously advanced over a distance equal to the distance between centre lines of two adjacent molds.

11. A system according to claim 10, wherein said dispensers discharge said amounts into a mold while cooling is applied to the bottom of said mold.

12. A method for casting electrodes in a stationary casting mold having a centre line, a bottom in the shape of an electrode having a substantially vertical continuous sidewall surrounding said bottom, said sidewall including opposed parallel sidewall portions; comprising attaching a layer of an insulating elastomeric compound to the full length of said continuous sidewall inside the mold whereby flash on the electrode edge is essentially eliminated; adding molten metal to said mold from two tipping melt dispensers positioned above said mold parallel to said centre line by tipping of said dispensers whereby melt dispensing from said dispensers flows substantially parallel to the full length of said sidewall portions towards said centre line such that wave action created in the melt in the mold by the dispensing of melt is substantially dampened and electrodes solidify essentially with even thickness; applying cooling to said bottom of the mold; and lifting said electrode from said mold.

13. A method is claimed in claim 12, wherein said mold is one of a multiplicity of molds positioned adjacent each other; and adding molten metal from a source of molten metal with transfer means to transfer molten metal from said source to said tipping dispensers.

14. A method according to claim 13, supporting said dispensers and said transfer means on a travelling carriage adapted to travel over said multiplicity of adjacent molds.

15. A method according to claim 14, wherein said transfer means includes two rotary dippers adapted to scoop molten metal from said source of molten metal; and discharging the scooped molten metal into said tipping dispensers.

16. A method according to claim 15, wherein said rotary dippers and said tipping dispensers sequentially cooperate in a manner whereby said rotary dippers scoop predetermined substantially equal amounts of molten metal from said source of molten metal, discharge into said dispensers each of said amounts while rotating, and said dispensers discharge said amounts into a mold while cooling is applied to the bottom of said mold.

17. A method according to claim 16, positioning a walking beam conveyor adjacent said multiplicity of molds.

18. A method according to claim 17, adapting said travelling carriage to travel over said conveyor.

19. A method according to claim 15, positioning a walking beam conveyor adjacent said multiplicity of molds, adapting said travelling carriage to travel over said conveyor, supporting said lifting means on said travelling carriage, and adapting said lifting means to travel transversely over said travelling carriage between said multiplicity of molds and said conveyor.

20. A method according to claim 19, wherein said rotary dippers and said dispensers sequentially cooperate in a manner whereby said rotary dippers scoop predetermined substantially equal amounts of molten metal from said source of molten metal, discharge into said tipping dispensers each of said amounts while rotating, said dispensers tip said amounts simultaneously into a first mold, and wherein during the sequential cooperation the lifting means removes an electrode from a mold adjacent said first mold and transfers the lifted electrode to said conveyor.

21. A method according to claim 20, wherein upon completion of said sequential cooperation and said transfer of electrode from the adjacent mold to the conveyor, said travelling carriage is indexed to over an empty mold adjacent said first mold and said lifting means is positioned over said first mold, while the electrode on said conveyor is simultaneously advanced over a distance equal to the distance between centre lines of two adjacent molds.

22. A method according to claim 21, wherein said dispensers discharge said amounts into a mold while cooling is applied to the bottom of said mold.

* * * * *